US010395579B2

(12) United States Patent
Tao

(10) Patent No.: US 10,395,579 B2
(45) Date of Patent: Aug. 27, 2019

(54) DISPLAY PANEL, DISPLAY APPARATUS AND SUB-PIXEL RENDERING METHOD

(71) Applicant: Linmi Tao, Beijing (CN)
(72) Inventor: Linmi Tao, Beijing (CN)

( * ) Notice: Subject to any disclaimer, the term of this patent is extended or adjusted under 35 U.S.C. 154(b) by 176 days.

(21) Appl. No.: 15/508,342

(22) PCT Filed: Sep. 5, 2014

(86) PCT No.: PCT/CN2014/086036
§ 371 (c)(1),
(2) Date: Nov. 6, 2017

(87) PCT Pub. No.: WO2016/033803
PCT Pub. Date: Mar. 10, 2016

(65) Prior Publication Data
US 2018/0047324 A1 Feb. 15, 2018

(51) Int. Cl.
*G09G 5/02* (2006.01)
*G09G 3/20* (2006.01)

(52) U.S. Cl.
CPC ... *G09G 3/2003* (2013.01); *G09G 2300/0443* (2013.01); *G09G 2300/0452* (2013.01);
(Continued)

(58) Field of Classification Search
CPC ..... G09G 3/20; G09G 3/2003; G09G 2300/0443; G09G 2300/0452;
(Continued)

(56) References Cited

U.S. PATENT DOCUMENTS 7,920,231 B2 * 4/2011 Tanno ..... G02F 1/134363 349/106
8,625,059 B2 * 1/2014 Nagami ..... G02F 1/133512 349/109
(Continued)

FOREIGN PATENT DOCUMENTS

CN 1588197 A 3/2005
CN 1738501 A 2/2006
(Continued)

OTHER PUBLICATIONS

International Search Report and Written Opinion for PCT/CN2014/086036 dated May 29, 2015.

*Primary Examiner* — Joe H Cheng
(74) *Attorney, Agent, or Firm* — Olive Law Group, PLLC

(57) ABSTRACT

A display panel, a display apparatus and a sub-pixel rendering method. The display panel is constituted by repeating pixel groups. Each pixel group is composed of a predetermined number of pixels arranged in a row, and each pixel is constituted by arraying sub-pixels of at least two different primary colors in different orders, wherein adjacent sub-pixels between adjacent pixels in each pixel group or adjacent sub-pixels between adjacent pixel pairs in each pixel group have an identical color. The adjacent sub-pixels having the identical color increase the saturation of a displayed color, so that a colored display screen has a higher color saturation, the displayed color is brighter, and levels are richer. One or more pairs among pairs constituted by the adjacent sub-pixels, having the identical color, of the adjacent pixels in each pixel group and pairs constituted by the adjacent sub-pixels, having the identical color, of the adjacent pixels between the pixel groups can be combined into a super sub-pixel, there is no black gap in the super sub-pixel, and the brightness of the super sub-pixel is greater than that of any one of the combined original sub-pixels having the identical color. The configuration of the super sub-pixel improves the utilization rate of a light source, reduces power consumption and also takes high pixel density into account.

18 Claims, 11 Drawing Sheets

(52) U.S. Cl.
CPC ..... *G09G 2320/0242* (2013.01); *G09G 2320/0626* (2013.01); *G09G 2320/0666* (2013.01); *G09G 2330/023* (2013.01); *G09G 2340/0457* (2013.01); *G09G 2360/16* (2013.01)

(58) Field of Classification Search
CPC ... G09G 2320/0242; G09G 2320/0626; G09G 2320/0666; G09G 2330/023; G09G 2340/0457; G09G 2360/16; G02B 5/20
See application file for complete search history.

(56) References Cited

U.S. PATENT DOCUMENTS 8,803,767 B2 * 8/2014 Phan ..... G09G 3/2003 345/55
9,093,017 B2 * 7/2015 Phan ..... G09G 3/2003
9,104,078 B2 * 8/2015 Kajita ..... G02F 1/136209
2002/0113921 A1 * 8/2002 Jiang ..... B82Y 15/00 349/96
2009/0015768 A1 * 1/2009 Igeta ..... G02F 1/133512 349/106
2009/0033845 A1 * 2/2009 Tanno ..... G02F 1/134363 349/106
2012/0212486 A1 * 8/2012 Van Der Horst ..... H04N 5/268 345/419
2012/0280896 A1 * 11/2012 Yamashita ..... G09G 3/3607 345/88
2015/0319822 A1 * 11/2015 Yang ..... H01L 27/3218 362/231
2015/0348458 A1 * 12/2015 Tian ..... G09G 3/2074 345/690

FOREIGN PATENT DOCUMENTS

CN 101344670 A 1/2009
CN 101359120 A 2/2009
JP H1184365 A 3/1999

* cited by examiner

| | 2010 | 2011 | 2012 | 2012 |
|---|---|---|---|---|
| Product | Galaxy S | Galaxy S2 | Galaxy S3 | Galaxy Note 2 |
| Layout of sub-pixels | PenTile (RG/BG) | Stripe (RGB) | PenTile (RG/BG) | S-Stripe (RGB) |

(a)

(b)

DISPLAY PANEL, DISPLAY APPARATUS AND SUB-PIXEL RENDERING METHOD

CROSS REFERENCE TO RELATED APPLICATION

This application is a 35 USC 371 application of International PCT Patent Application No. PCT/CN2014/086036, filed on Sep. 5, 2014; the content of which is hereby incorporated by reference herein in its entirety.

TECHNICAL FIELD

The present disclosure relates to a display panel and a display apparatus, which can be used as a coloured display panel and a display apparatus of various apparatuses, such as various mobile phones, a tablet personal computer, a laptop, a monitor, and a television, and further relates to a sub-pixel rendering method of the display apparatus.

BACKGROUND

Various widely used coloured display screens at present, such as a Cathode Ray Tube (CRT) display screen, a light-emitting diode (LED) display screen, an Organic Light Emitting Diode (OLED) display screen, a liquid crystal display (LCD), etc., are all formed by arranging pixels. A coloured display screen includes a plurality of pixels, for example, 640×480, 1024×768, 1920×1080 pixels, and so on. Each pixel includes two or three or more sub-pixels of different colours, wherein, which is more common is that each pixel has three sub-pixels, i.e., a red sub-pixel, a green sub-pixel and a blue sub-pixel. The three sub-pixels are arranged in parallel, to form one pixel.

In order to prevent distortion of an image displayed, each pixel is generally square, and thus, the sub-pixel is rectangular with an aspect ratio of 3:1, as shown in FIG. 1. The plurality of pixels are repeatedly arranged to form the coloured display screen, as shown in FIG. 2. Of course, some of these pixels are self-luminous, for example, an LED coloured display screen, an Active Matrix/Organic Light Emitting Diode (AMOLED) coloured display screen, and so on, and some per se do not emit light, but depend on backlight to supply a light source uniformly, for example, a Passive matrix OLED (PMOLED) coloured display screen and an LCD coloured display screen, and so on.

An important indicator of the coloured display screen is Pixels Per Inch (PPI), that is, a pixel density of the coloured display screen. A major direction of current development of the coloured display screen, is to improve the pixel density of the coloured display screen. A mobile phone screen, a computer screen, and a 4K television of high-resolution in fiery development, etc., put forward higher and higher requirements on the pixel density of the coloured display screen. For example, a Retina coloured display screen produced by the Apple Computer, Inc. has a coloured display screen of high-resolution achieved by reducing a size of each pixel, which has been used in an iphone, a tablet personal computer, a laptop, and so on. The method of directly increasing the pixel density brings two problems difficult to overcome, one is that a fabrication process is complicated, with a low yield, resulting in a high price of the coloured display screen of high-resolution, and the other is that increase in the pixel density means reduction of an area of each pixel, and there is a black gap between the sub-pixels. Therefore, reduction of an area of the sub-pixel renders increase in an area taken by the gap between the sub-pixels, so that a utilization rate of the light source is lowered, and energy consumption of the coloured display screen is remarkably increased in order to achieve a same brightness. This is a fatal weakness for mobile devices such as a mobile phone, a tablet personal computer and a laptop.

In order to reduce the production cost of the coloured display screen and energy consumption in use while improving pixel density, the Samsung Corporation has proposed a variety of new designs and manufacturing methods of the coloured display screen. The corporation improves the pixel density by reducing the number of sub-pixels in each pixel in a Pentile RGBW colour display screen and a Pentile RGBG colour display screen, wherein, the RGBW coloured display screen has sub-pixels of four colours (red, green, blue and white), but each pixel has only two sub-pixels, i.e., blue-white or red-green, with reference to FIG. 3. And in the RGBG coloured display screen, there are ordinary sub-pixels of three colours, but each pixel has only two sub-pixels, i.e., green-blue, or green-red, with reference to FIG. 4. These coloured display screens have the pixel density thereof improved without reducing a size of each sub-pixel. As compared with the Retina coloured display screen of the Apple Inc., it has advantages such as low power consumption and a low cost. Therein, the RGBW coloured display screen has been used in apparatuses below:

Motorola MC65
Motorola ES55
Motorola ES400
Motorola Atrix 4G
Samsung Corporation Galaxy Note 10.1 2014 version
Lenovo Yoga 2 Pro
HP ENVY TouchSmart 14-k022tx Sleekbook The RGBG coloured display screen is a very successful coloured display screen of the Samsung Corporation, which has been widely used in a variety of mobile phones, as follows:

BlackBerry Q10
Nexus One
HTC Desire (AMOLED variantsonly)
Samsung Corporation S8000
Samsung Corporation Galaxy S
Samsung Corporation Galaxy S Plus
Samsung Corporation Galaxy S III
Samsung Corporation Galaxy S III Mini
Samsung Corporation Galaxy S 4
Samsung Corporation Galaxy Note
Samsung Corporation Wave S8500
Samsung Corporation Ativ S
Samsung Corporation NX10
Nexus S (Super AMOLED variants only)
Galaxy Nexus
Dell Venue Pro
Nokia N9
Nokia Lumia 800
Nokia Lumia 925
Nokia Lumia 928
Nokia Lumia 1020
HTC One S
Pantech Burst
Huawei Ascend P1
Alcatel One Touch Star 6010D
Motorola RAZR i In addition to the above-described method of improving the pixel density by reducing the number of sub-pixels, a variable-structure sub-pixel coloured display screen obtains a higher pixel density and a better display effect by varying a structure of the sub-pixel, for example, an S-Strip coloured display screen of the Samsung Corporation; as shown in FIG. 5, a blue sub-pixel is a long strip, and a red sub-pixel and a green sub-pixel are small squares, which are arranged intersecting with one another to form one pixel. The Samsung coloured display screen technology-related patents are shown in FIG. 6, wherein, a mobile phone Galary S in 2010 and a mobile phone Galary S3 in 2012 use the PenTile RGBG coloured display screen (by the RG pixel and the BG pixel), a mobile phone Galary S2 in 2011 uses a Stripe coloured display screen (the RGB pixel), and a mobile phone Galary Note2 in 2012 uses the S-Stripe coloured display screen (the RGB pixel).

In summary, it can be seen that, at present, a main method for improving the pixel density is to reduce the number of sub-pixels within a single pixel. The method improves the pixel density, while reducing a ratio of a black gap region of a pixel, improving the utilization rate of the light source and reducing the energy consumption for achieving the same brightness. However, as compared with a traditional three-primary colour sub-pixel method, the method reduces quality of the image, so that the displayed image has a certain degree of colour cast.

SUMMARY

The present disclosure has been made in view of the above-described circumstances in the prior art.

According to an aspect of the present disclosure, there is provided a display panel, mainly constituted by repeating pixel groups, the pixel group being composed of a predetermined number of pixels arranged in a row, and each pixel being constituted by arraying sub-pixels of at least two different primary colours in different orders, wherein adjacent sub-pixels between adjacent pixels in each pixel group or adjacent sub-pixels between adjacent pixel pairs have an identical colour, and the first sub-pixel and the last sub-pixel in the pixel group have an identical colour.

The display panel according to the embodiment of the present disclosure, by making the adjacent sub-pixels of the adjacent pixels have an identical colour, can increase saturation of a displayed colour, so that the displayed colour is brighter, and levels are richer.

In one example, for the above-described display panel, one or more pairs among pairs constituted by the adjacent sub-pixels, having the identical colour, of the adjacent pixels in each pixel group and pairs constituted by the adjacent sub-pixels, having the identical colour, of the adjacent pixels between the pixel groups are combined into a super sub-pixel, there is no black gap in the super sub-pixel obtained as so combined, and the brightness of the super sub-pixel is greater than that of any one of the combined original sub-pixels having the identical colour. The configuration of the super sub-pixel improves the utilization rate of a light source, reduces power consumption of a coloured display and also takes high pixel density into account.

According to another aspect of the present disclosure, there is provided a display apparatus, which may comprise: a display panel, mainly constituted by repeating pixel groups, the pixel group being composed of a pre-determined number of pixels arranged in a row, and each pixel being constituted by arraying sub-pixels having different primary colours in different orders, wherein there are at least two primary colours, and wherein adjacent sub-pixels between adjacent pixels in each pixel group or adjacent sub-pixels between adjacent pixel pairs in each pixel group have an identical colour, and the first sub-pixel and the last sub-pixel in the pixel group have an identical colour; and a driving circuit, for transmitting a signal to each sub-pixel of the display panel.

According to still another aspect of the present disclosure, there is provided a display apparatus, which may comprise: a display panel, constituted by arranging a plurality of pixels, each pixel being constituted by arranging sub-pixels having different colours in a row, wherein adjacent sub-pixels between adjacent pixels in a same row or adjacent sub-pixels between adjacent pixel pairs in a same row have an identical colour; and a driving circuit, for transmitting a signal to each sub-pixel of the display panel.

According to still another aspect of the present disclosure, there is provided a sub-pixel rendering method of a display apparatus, the display apparatus comprising: a display panel, constituted by arranging a plurality of pixels, each pixel being constituted by arranging sub-pixels having different colours in a row, wherein adjacent sub-pixels between adjacent pixels in a same row or adjacent sub-pixels between adjacent pixel pairs in a same row have an identical colour, wherein, adjacent sub-pixels, having the identical colour, of the adjacent pixels in a same row are selectively or completely combined into a super sub-pixel, there is no black gap in the super sub-pixel, and the brightness of the super sub-pixel is greater than that of any one of the combined original sub-pixels having the identical colour, and an arrangement mode of the sub-pixels in the display panel defines an output display format; the sub-pixel rendering method comprising: receiving input image data in a first format so that the display apparatus renders in the output display format; executing a sub-pixel rendering operation based on the input image data, to generate a brightness value of each sub-pixel on the display panel; transmitting a signal to each sub-pixel of the display panel, wherein the rendering a super sub-pixel includes: obtaining a colour value corresponding to a colour of the super sub-pixel in the colour value of each of the associated two pixels of the input image data; and taking a summation result of the two corresponding colour values as the colour value of the super sub-pixel.

The sub-pixel rendering method according to the embodiment of the present disclosure makes the display apparatus maintain good colour reproduction ability and low power consumption while achieving a high pixel density.

BRIEF DESCRIPTION OF THE DRAWINGS

These and/or other advantages of the present disclosure will become more apparent and understandable from the detailed description of the embodiments of the present disclosure in conjunction with the accompanying drawings, in which.

DETAILED DESCRIPTION

Figure 1:
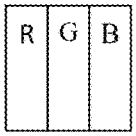
FIG. 1 shows a schematic diagram of a square pixel constituted by RGB sub-pixels.
Figure 2:
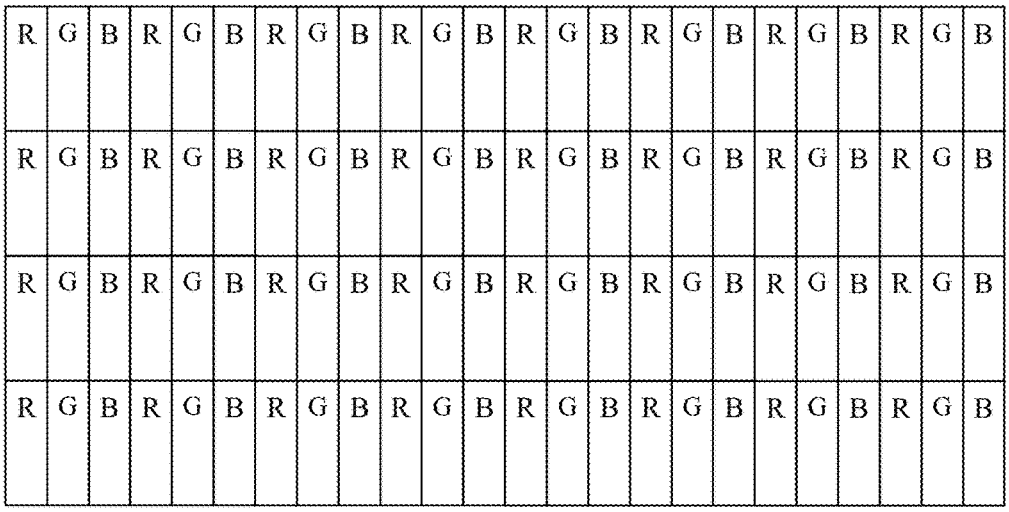
FIG. 2 shows a schematic diagram of a conventional coloured display screen formed by repeatedly arranging a plurality of pixels.
Figure 3:
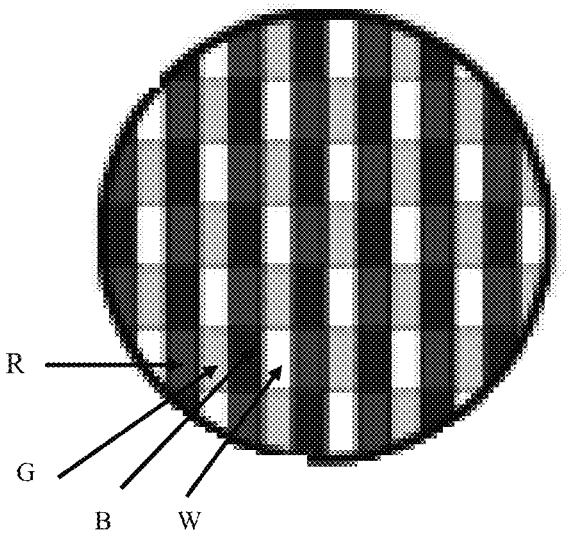
FIG. 3 shows a schematic diagram of a conventional Pentile RGBW coloured display screen manufactured by the Samsung Corporation.
Figure 4:
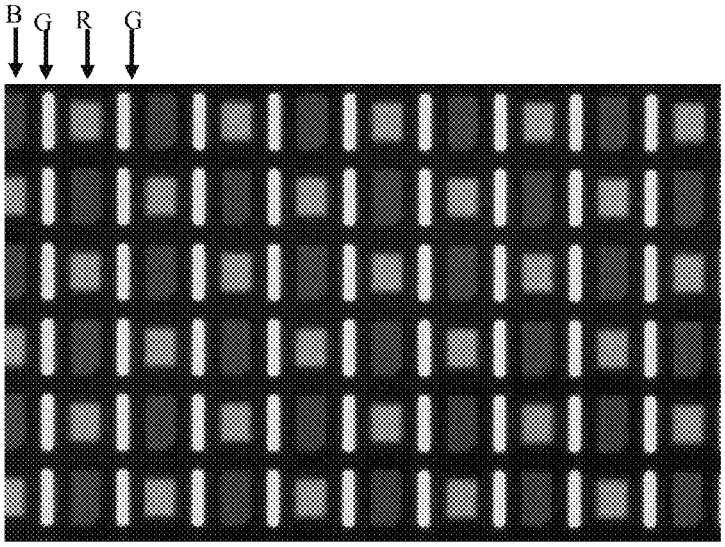
FIG. 4 shows a schematic diagram of a conventional Pentile RGBG coloured display screen manufactured by the Samsung Corporation.
Figure 5:
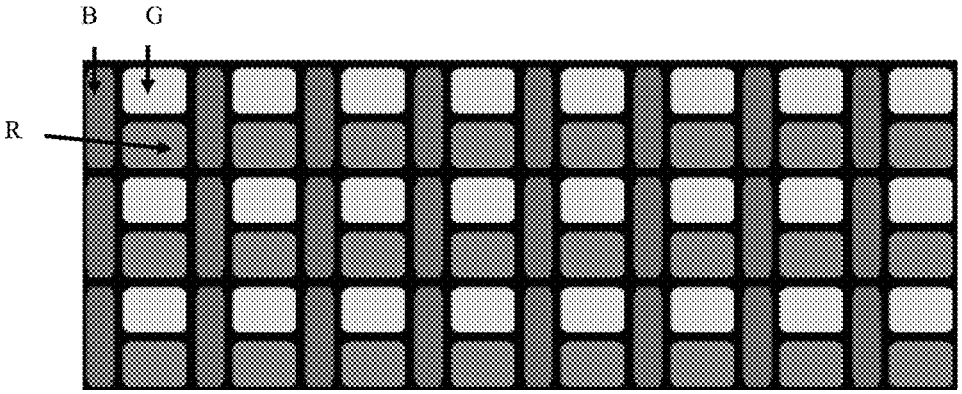
FIG. 5 shows a schematic diagram of a conventional S-Strip coloured display screen manufactured by the Samsung Corporation.
Figure 6:
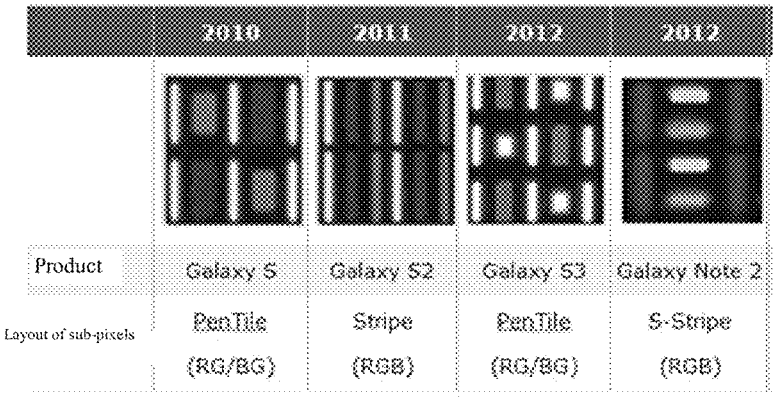
FIG. 6 shows a schematic diagram of the coloured display screen of the Samsung Corporation in a related art.

In order to make those skilled in the art better understand the technical solutions of the present disclosure, the present disclosure is further described in detail in conjunction with the drawings and specific embodiments.

First of all, meanings of some of the terms in the text are explained.

The term "pixel", also referred to as a picture element, is a basic unit of image display, and is an English word; pix is a commonly used shorthand for an English word "picture", and when added with an English word "element", "pixel" is got, and thus the term "pixel" represents a meaning of "picture element". Each pixel may have its own colour value, and thus has a corresponding concept of "sub-pixel", for example, the pixel may be displayed by three primary colours, and thus is further divided into three types of sub-pixels: red, green and blue (an RGB colour gamut), or may be represented by using four types of sub-pixels: cyan, magenta, yellow and black (a CMYK colour gamut, commonly seen in a printing industry and a printer), or may also be represented by using four types of sub-pixels: red, green, blue and white (an RGBW colour gamut), or may be represented by using more primary colours.

The term "primary colour" represents each colour in repeating sub-pixel groups, for example, red (R), green (G) and blue (B) in the RGB sub-pixel are referred to as the three primary colours, and red (R), green (G), blue (B) and white (W) in the RGBW sub-pixel are also primary colours.

The term "between adjacent pixel pair" in the text, refers to that two pixels form a pixel pair successively in an order in which the pixels are arranged in the pixel group, there is no repeated pixel among respective pixel pairs, and a case between the adjacent pixel pair will be described as follows. For example, in an example which will be described later, in a four primary-colour octagonal pixel group "P1 P2 P3 P4 P4 P1 P2 P3 P3 P4 P1 P2 P2 P3 P4 P1", in a left-to-right order, the first pixel includes sub-pixels P1 P2, the second pixel includes sub-pixels P3 P4, the third pixel includes sub-pixels P4 P1, the fourth pixel includes sub-pixels P2 P3, . . . and the eighth pixel includes sub-pixels P4 P1, wherein the first and the second pixels, the third and the fourth pixels, the fifth and the sixth pixels, the seventh and the eighth pixels sequentially constitute pixel pairs in a pairwise manner. Each pixel pair includes four primary-colour sub-pixels P1, P2, P3 and P4. Here, the first pixel pair is constituted by the first and the second pixels, the second pixel pair is constituted by the third and the fourth pixels, the third pixel pair is constituted by the fifth and the sixth pixels, and the fourth pixel pair is constituted by the seventh and the eighth pixels; and there is not a pixel pair constituted by the second pixel and the third pixel, or a pixel pair constituted by the fourth pixel and the fifth pixel, and so on.

In a subsequent example, description will be provided mainly with a case where the type of sub-pixel is the RGB sub-pixel; however, the present disclosure is not limited thereto, and the types and the number of sub-pixels (primary colour) may be different.

The present disclosure provides a display panel, constituted by repeating pixel groups, the pixel group being composed of a pre-determined number of pixels arranged in a row, and each pixel being constituted by arraying sub-pixels of at least two different primary colours in different orders, wherein adjacent sub-pixels between adjacent pixels in each pixel group or adjacent sub-pixels between adjacent pixel pairs in each pixel group have an identical colour, and the first sub-pixel and the last sub-pixel in the pixel group have an identical colour. The adjacent sub-pixels having the identical colour increase saturation of a displayed colour, so that the coloured display screen proposed by the present disclosure has colour saturation higher than that of an existing coloured display screen, the displayed colour is brighter, and levels are richer.

Figure 7:
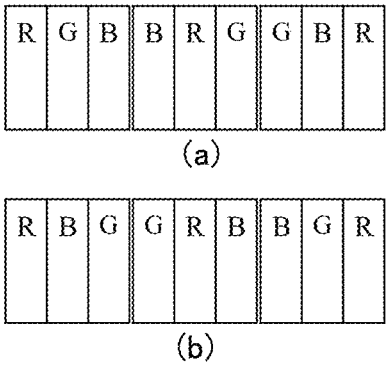
FIG. 7(*a*) and FIG. 7 (*b*) show two exemplary arrangement modes of sub-pixels of an RGB three-primary colour pixel group according to one embodiment of the present disclosure.

For example, a display screen is mainly constituted by repeating the pixel groups, and the pixel group is composed of three pixels arranged in a row. Each pixel is constituted by three sub-pixels of three colours: red, green and blue. The adjacent sub-pixels between the adjacent pixels in the pixel group have the identical colour, and the first sub-pixel and the last sub-pixel in the pixel group have the identical colour. For example, an exemplary arrangement mode of all the sub-pixels of the three pixels in the pixel group is: a red sub-pixel, a green sub-pixel, a blue sub-pixel, a blue sub-pixel, a red sub-pixel, a green sub-pixel, a green sub-pixel, a blue sub-pixel and a red sub-pixel, as shown in FIG. 7(*a*). Another exemplary arrangement mode of all the sub-pixels of the three pixels in the pixel group is: a red sub-pixel, a blue sub-pixel, a green sub-pixel, a green sub-pixel, a red sub-pixel, a blue sub-pixel, a blue sub-pixel, a green sub-pixel and a red sub-pixel, as shown in FIG. 7(*b*).

It should be noted that: in the examples shown in FIG. 7(*a*) and FIG. 7(*b*) mentioned before, the pixel group starts with a red sub-pixel and ends with a red sub-pixel; however, this is only an example; in fact, the starting sub-pixel and the ending sub-pixel in the pixel group may be sub-pixels of other colours.

Actually, the display screen according to one embodiment of the present disclosure may be summarized as: sub-pixels of three primary colours constitute a pixel, three different pixels are arranged in a row to constitute a pixel group, and the pixel group is repeated to form the display screen. In other words, it is assumed that P1, P2 and P3 respectively represent sub pixels of a first primary colour, a second primary colour and a third primary colour, and all the sub-pixels of the three pixels in the pixel group are arranged in a row in a mode below:

P1 P2 P3 P3 P1 P2 P2 P3 P1

It should be noted that: here P1, P2 and P3 are respectively one of the three primary colours, and are different from one another. It should be noted that: although hereinafter, it is usually described with a case where P1 is red, P2 is green and P3 is blue as an example, in fact, P1 may be green or blue, and either of P2 and P3 may be other colours. Preferably, all the sub-pixels in one pixel group include sub-pixels of all the primary colours, and the numbers of the sub-pixels of respective primary colours are equal within a same pixel group, which can avoid colour cast of the displayed image and ensure display quality.

Figure 8:
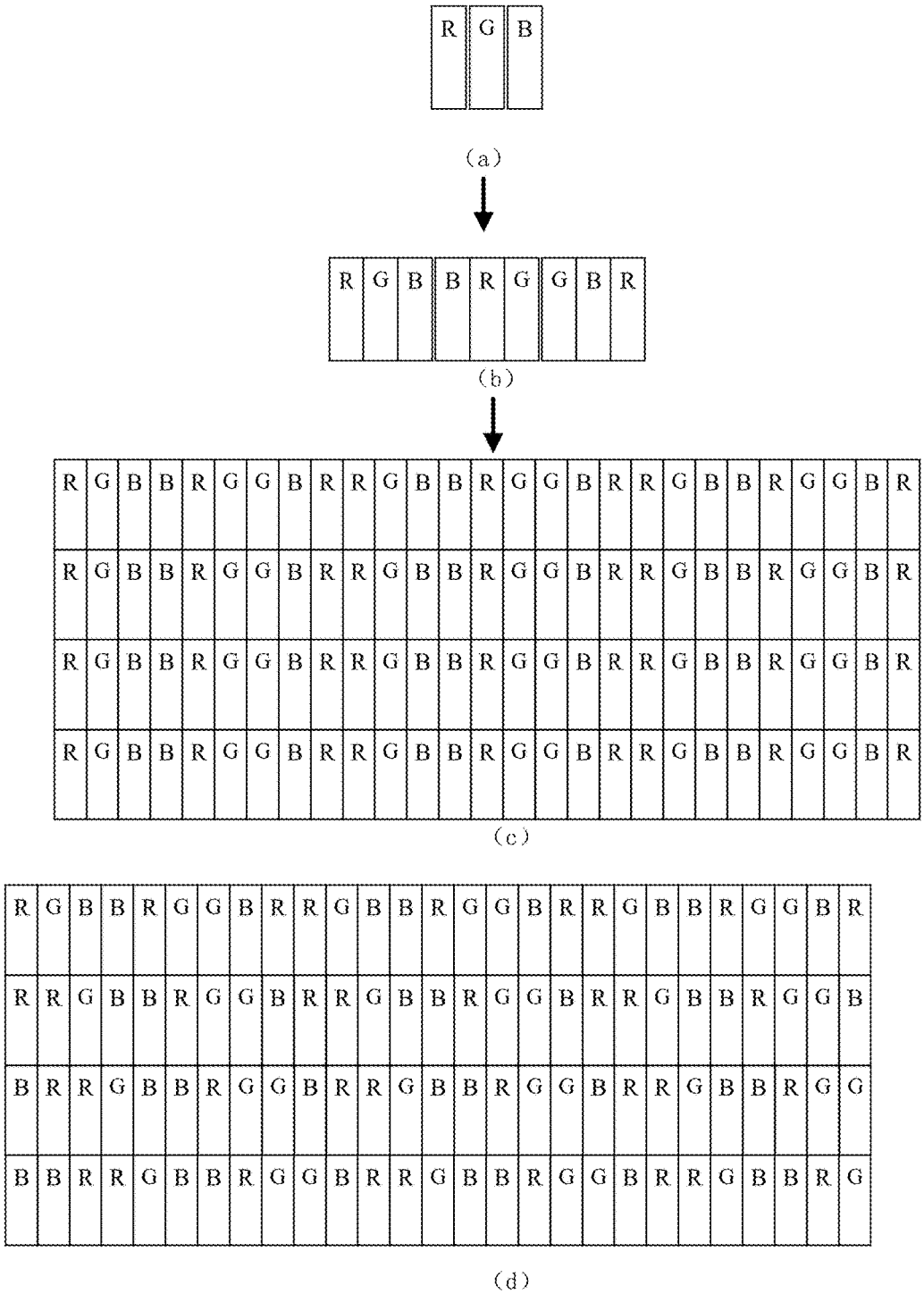
FIG. 8(*a*), FIG. 8(*b*), and FIG. 8(*c*) respectively show schematic diagrams of a sub-pixel, a pixel group, a portion of a display screen with arrangement of identical colour between rows, and a portion of a display screen with arrangement of different colours between rows.

In the above-described embodiment of the present disclosure, nine sub-pixels are arranged to form a triple pixel group constituted by three adjacent pixels; and for brevity, this type of triple pixel group is referred to as Tao's Triple Pixels (TTP). And then a plurality of TTPs are arranged repeatedly, to form the coloured display screen, which may be referred to as a Tao's Triple Pixel Display (TTPD), as shown in FIG. 8. It can be seen that, the conventional coloured display screen is formed by arranging the pixels, but the Tao's Triple Pixel Display (TTPD) according to the embodiment of the present disclosure is formed by repeatedly arranging the Tao's Triple Pixels (TTP), and a characteristic of the display screen is that the adjacent sub-pixels between all the adjacent pixels have an identical colour.

In fact, the display screen according to another embodiment of the present disclosure may be summarized as: sub-pixels of four primary colours constitute a pixel pair, four pairs, i.e., eight pixels are arranged in one row to form a pixel group, and the pixel group is repeated to form the display screen. In other words, it is assumed that P1, P2, P3 and P4 respectively represent sub-pixels of a first primary colour, a second primary colour, a third primary colour, and a fourth primary colour, and all the four pairs, i.e., eight pixels in the pixel group are arranged in a row in a mode below:

P1 P2 P3 P4 P4 P1 P2 P3 P3 P4 P1 P2 P2 P3 P4 P1

It should be noted that: here P1, P2, P3 and P4 are respectively one of the four primary colours, and are different from one another. In the pixel group, the first pixel includes the sub-pixels P1 P2, the second pixel includes the sub-pixels P3 P4, the third pixel includes the sub-pixels P4 P1, the fourth pixel includes the sub-pixels P2 P3, . . . and the eighth pixel includes the sub-pixels P4 P1, wherein, the first and the second pixels, the third and the fourth pixels, the fifth and the sixth pixels, the seventh and the eighth pixels sequentially constitute pixel pairs in a pairwise manner, that is, in the example, the first pixel pair is P1 P2 P3 P4, the second pixel pair is P4 P1 P2 P3, the third pixel pair is P3 P4 P1 P2, and the fourth pixel pair is P2 P3 P4 P1. Each pixel pair includes four primary-colour sub-pixels P1, P2, P3 and P4, that is, each four adjacent primary-colour sub-pixels constitute a pixel pair. It should be noted that, although in the text, the four primary colours are represented with red, green, blue and white as an example, in fact, the four primary colours may also be other colours. Preferably, all the sub-pixels in one pixel group include the sub-pixels of all the primary colours, and the numbers of the sub-pixels of respective primary colours are equal within a same pixel group, which can avoid colour cast of the displayed image and ensure display quality.

In the above-described embodiment of the present disclosure, eight pixels are arranged to form an octagonal pixel group constituted by four pairs of adjacent pixel pairs; and for brevity, this type of octagonal pixel group is referred to as a Tao's Octagonal Pixels (TOP). And then a plurality of TOPs are arranged repeatedly, to form the coloured display screen, which may be referred to as a Tao's Octagonal Pixel Display (TOPD). The conventional coloured display screen is formed by arranging the pixels, but the Tao's Octagonal Pixel Display (TOPD) according to the embodiment of the present disclosure is formed by repeatedly arranging the Tao's Octagonal Pixels (TOP), and a characteristic of the display screen is that the adjacent sub-pixels between all the adjacent pixels have an identical colour.

Hereinbefore, it has been described respectively with the triple pixel group of three primary colours, and the octagonal pixel group of four primary colours as an example. However, this is only an example, and in fact, the pixel group may be constituted by more kinds of pixels.

For example, similarly, P1, P2 and P3 are used to represent sub-pixels of a first primary colour, a second primary colour, and a third primary colour respectively, and here, it is only required that P1, P2 and P3 are one of the three primary colours and are different from one another, but it is not necessary that P1, P2 and P3 are fixed primary colours. For example, the pixel group may be constituted in either of two modes below.

For example, a first mode: the pixel group is composed of five pixels, each pixel is formed by arranging the sub-pixels of the three primary colours, and the sub-pixels of the five pixels in the pixel group are arranged in a row in a mode below:

P1 P2 P3 P3 P1 P2 P2 P3 P1 P1 P3 P2 P2 P3 P1

For another example, a second mode: the pixel group is composed of six pixels, each pixel is formed by arranging the sub-pixels of the three primary colours, and the sub-pixels of the six pixels in the pixel group are arranged in a row in a mode below:

P1 P2 P3 P3 P1 P2 P2 P3 P1 P1 P3 P2 P2 P1 P3 P3 P2 P1

It should be noted that, description has been provided above with the triple, the quintuple and the sextuple pixel groups of the three primary colours, and the octagonal pixel group of the four primary colours as an example. However, this is only an example, the display screen may have more primary colours, and the pixel group may have more pixels. In fact, it is only necessary for the configuration of the coloured display screen according to the embodiment of the present disclosure to meet conditions as follows: the display screen is constituted by repeating pixel groups, the pixel group is composed of a pre-determined number of pixels arranged in a row, and each pixel is constituted by arraying sub-pixels having different primary colours in different orders, wherein there are at least two primary colours, and wherein adjacent pixels (for example, in a case of three primary colours) or adjacent sub-pixels (for example, in a case of four primary colours) between adjacent pixel pairs in the pixel group have an identical colour, and the first sub-pixel and the last sub-pixel in the pixel group have an identical colour.

In general, in order to prevent distortion of an image displayed, each pixel is generally square. In one example, it is assumed that a pixel group is constituted by N pixels, and an aspect ratio of the pixel group is set to N:1, so that each pixel is a square on average, where N is an integer greater than or equal to 3.

After the pixel group is obtained, the pixel groups are arranged repeatedly to obtain the display screen. In practical manufacturing of the display screen, usually a very large display panel is manufactured, and then the large display panel is cut to obtain a display screen of a desired size. In the present text, the "display screen" and the "display panel" have an identical meaning and are used interchangeably.

It should be noted that, in the present text, the display screen or the display panel is described to be "mainly" constituted by repeating pixel groups, because as commonly known by those skilled in the art, due to a size and/or production factor or limitation of the display panel, the pixel group at one or more edges of the display panel is incomplete.

By repeating the pixel group, the coloured display screen may be formed, and there are various methods for repeating, which may include an arrangement of identical colour between rows and an arrangement of different colours between rows, the arrangement of identical colour between rows refers to that the sub-pixels in corresponding positions between respective rows have an identical colour, and the arrangement of different colours between rows refers to that the sub-pixels in corresponding positions between respective rows have different colours. For the coloured display screen according to the embodiment of the present disclosure, whether the arrangement of identical colour between rows or the arrangement of different colours between rows, they have a common feature that two adjacent sub-pixels between any two adjacent pixels in a same row have an identical colour. The adjacent sub-pixels having the identical colour increase saturation of a displayed colour, so that the coloured display screen proposed by the present disclosure has colour saturation higher than that of an existing coloured display screen, the displayed colour is brighter, and levels are richer.

FIG. 8(*a*), FIG. 8(*b*), FIG. 8(*c*) and FIG. 8(*d*) respectively show schematic diagrams of a sub-pixel, a pixel group, a portion of a display screen with an arrangement of identical colour between rows, and a portion of a display screen with an arrangement of different colours between rows, wherein FIG. 8(*a*) shows red, green and blue sub-pixels; FIG. 8(*b*) shows the pixel group, whose sub-pixels are arranged as red, green, blue, blue, red, green, green, blue, red; FIG. 8(*c*) shows the portion of the display screen with the arrangement of identical colour between rows; as shown in the diagram, corresponding pixels between different rows have an identical colour, which manifests as that the sub-pixels in each column have an identical colour, for example, sub-pixels in a first column are all red, sub-pixels in a second column are all green, and so on; FIG. 8(*d*) shows a schematic diagram of the portion of the display screen with the arrangement of different colours between rows, as shown in the diagram, corresponding pixels between different rows have different colours, which manifests as that not all the sub-pixels in each column have an identical colour, for example, four sub-pixels in the first column have colours: red, red, blue, and green, and four sub-pixels in the second column have colours: green, red, red, blue, and so on.

In one example, one or more pairs among pairs constituted by the adjacent sub-pixels, having the identical colour, of the adjacent pixels in each pixel group and pairs constituted by the adjacent sub-pixels, having the identical colour, of the adjacent pixels between the pixel groups can be combined into a super sub-pixel, there is no black gap in the super sub-pixel obtained as so combined, and the brightness of the super sub-pixel is greater than that of any one of the combined original sub-pixels having the identical colour. The configuration of the super sub-pixel reduces the black gap in the display screen, improves the utilization rate of a light source, and reduces power consumption.

Figure 9:
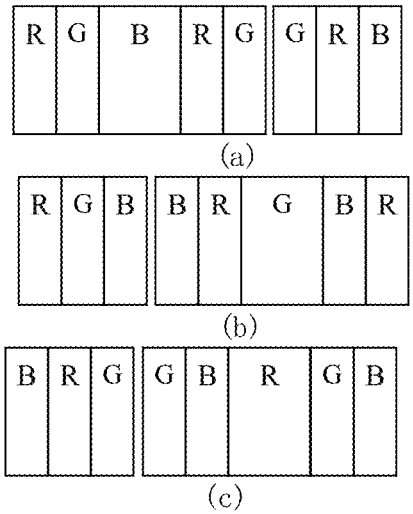
FIG. 9(*a*), FIG. 9(*b*), FIG. 9(*c*) and FIG. 9(*d*) show schematic diagrams of a case where every nine sub-pixels (or each Tao's Triple pixel) include one super sub-pixel.

For example, for the Tao's Triple pixel as described above, two adjacent sub-pixels having an identical colour among nine sub-pixels within the Tao's Triple pixel may be selectively combined into a super sub-pixel. For example, two adjacent blue sub-pixels within the Tao's Triple pixel are combined into a blue super sub-pixel, as shown in FIG. 9(*a*). For another example, two adjacent green sub-pixels within the Tao's Triple pixel are combined into a green super sub-pixel, as shown in FIG. 9(*b*). For another example, adjacent sub-pixels, having an identical colour, of adjacent pixels between pixel groups are combined into a super sub-pixel, for example, as shown in FIG. 7(*a*), adjacent red sub-pixels between a Tao's Triple pixel and an adjacent Tao's Triple pixel are combined into a red super sub-pixel, as shown in FIG. 9(*c*). In the example shown in FIG. 9(*a*), FIG. 9(*b*) and FIG. 9(*c*), every nine sub-pixels (or each Tao's Triple pixel) includes a super sub-pixel. According to different colours of the super sub-pixels within the Tao's Triple pixel, there are totally three different types of Tao's Triple pixels, i.e., a Tao's Triple pixel TTP-R including a red super sub-pixel, a Tao's Triple pixel TTP-G including a green super sub-pixel, and a Tao's Triple pixel TTP-B including a blue super sub-pixel. A coloured display screen may include one or more types of Tao's Triple pixel having super sub-pixels of different colours. It should be noted that, in FIG. 9(*a*), FIG. 9(*b*), FIG. 9(*c*) and subsequent diagrams, the super sub-pixel is displayed as a sub-pixel having a width greater than other sub-pixels.

Figure 10:
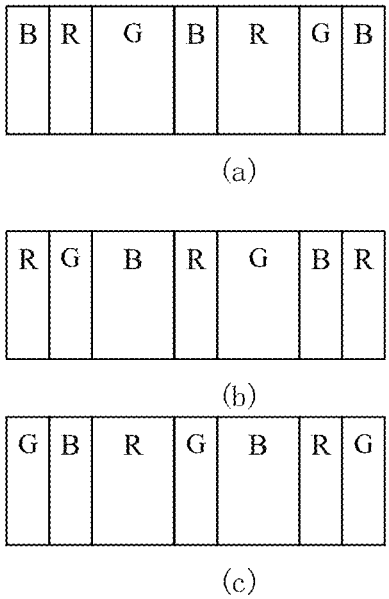
FIG. 10(*a*), FIG. 10(*b*), and FIG. 10(*c*) show schematic diagrams of a case where every nine sub-pixels (or each Tao's Triple pixel) include two super sub-pixels.

In the foregoing example, a Tao's Triple pixel includes a super sub-pixel. However, this is only an example, a Tao's Triple pixel may include two super sub-pixels, or every nine sub-pixel includes two super sub-pixels. According to different colours of the super sub-pixels within the Tao's Triple pixel, there are totally three different types of Tao's Triple pixels, i.e., a Tao's Triple pixel TTP-RG (FIG. 10(*a*)) including a red super sub-pixel and a green super sub-pixel, a Tao's Triple pixel TTP-GB (FIG. 10(*b*)) including a green super sub-pixel and a blue super sub-pixel and a Tao's Triple pixel TTP-BR (FIG. 10(*c*)) including a blue super sub-pixel and a red super sub-pixel. A coloured display screen may include one or more types of Tao's Triple pixel having super sub-pixels of different colours.

Figure 11:
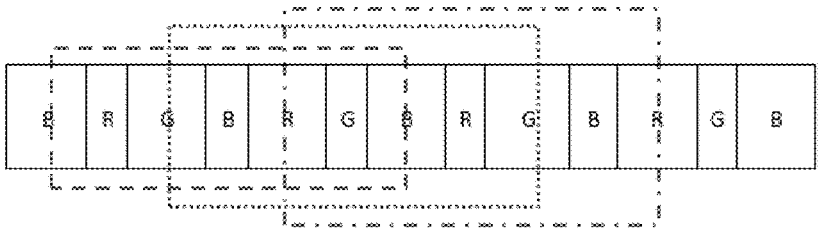
FIG. 11(*a*) and FIG. 11(*b*) show existing forms of the Tao's Triple pixel group and a Tao's Octagonal pixel group in an average sense, in which FIG. 11(*a*) shows a schematic diagram of a case where each nine sub-pixels include three super sub-pixels in the Tao's Triple pixel group in an average sense, and FIG. 11(*b*) shows a schematic diagram of a case where each sixteen sub-pixels include four super sub-pixels in the Tao's Octagonal pixel group in an average sense.
Figure 11:
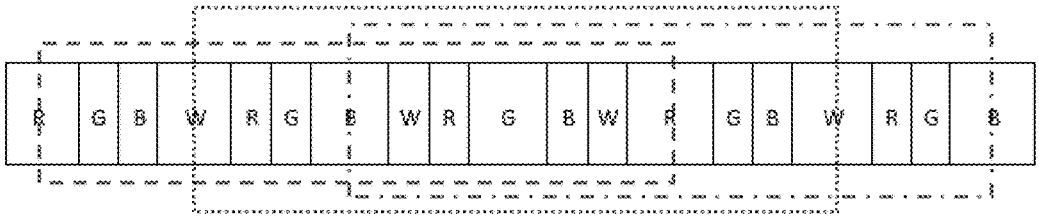

In one example, in an average sense, a Tao's Triple pixel may include three super sub-pixels, or every nine sub-pixels include three super sub-pixels. A Tao's Triple pixel includes three super sub-pixels (TTP-3, TTP-RGB). As shown in FIG. 11(*a*), in a coloured display screen, there is only one type of Tao's Triple pixel TTP-RGB. Similarly, in one example, in an average sense, a Tao's Octagonal pixel may include four super sub-pixels, or in an average sense, every sixteen sub-pixels include four super sub-pixels. A Tao's Octagonal pixel includes four super sub-pixels (TOP-4, TOP-RGBW). As shown in FIG. 11(*b*), in a coloured display screen, there is only one type of Tao's Octagonal pixel TOP-RGBW.

Figure 12:
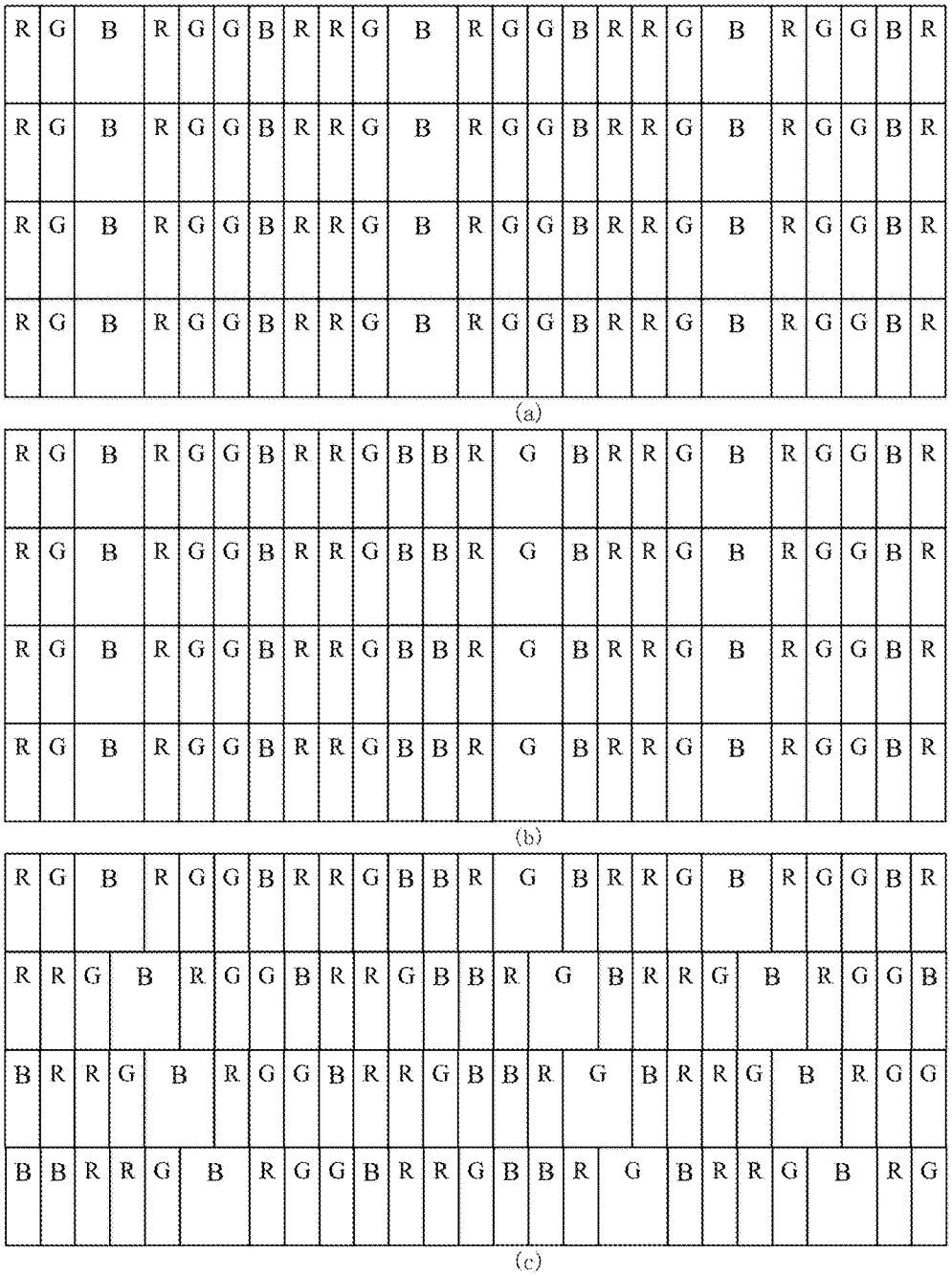
FIG. 12(*a*), FIG. 12(*b*) and FIG. 12(*c*) show a portion of an exemplary coloured display screen in which each Tao's Triple pixel includes one super sub-pixel according to an embodiment of the present disclosure.
Figure 13:
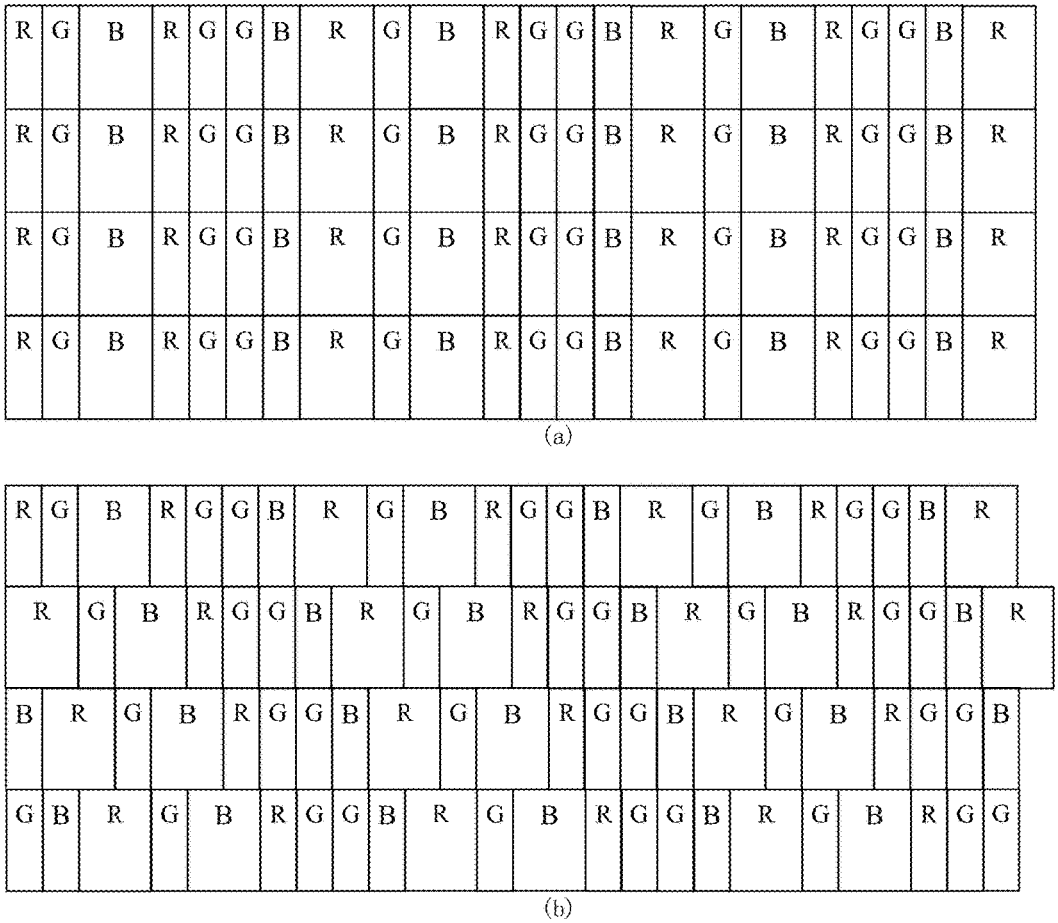
FIG. 13(*a*) and FIG. 13(*b*) show a portion of an exemplary coloured display screen in which each Tao's Triple pixel includes two super sub-pixels according to an embodiment of the present disclosure.
Figure 14:
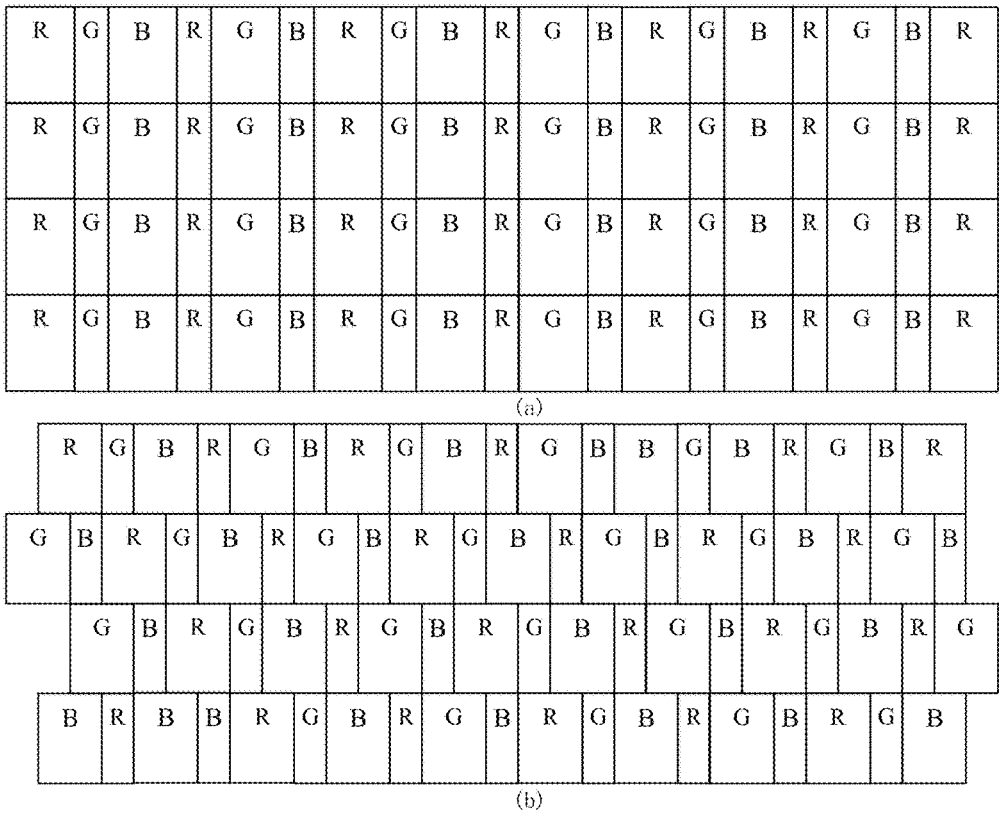
FIG. 14(*a*) and FIG. 14(*b*) show a portion of an exemplary coloured display screen in which each Tao's Triple pixel includes three super sub-pixels according to an embodiment of the present disclosure.

FIG. 12(*a*), FIG. 12(*b*) and FIG. 12(*c*) show a portion of an exemplary coloured display screen in which each Tao's Triple pixel includes one super sub-pixel according to an embodiment of the present disclosure, wherein FIG. 12(*a*) and FIG. 12(*b*) show the arrangement of identical colour between rows, and FIG. 12(*c*) shows the arrangement of different colours between rows. More specifically, the display screen in FIG. 12(*a*) has only one type of Tao's Triple pixel TTP-B, that is, each Tao's Triple pixel includes only a blue super sub-pixel; the display screen in FIG. 12(*b*) has two types of Tao's Triple pixel TTP-B and TTP-G, that is, a Tao's Triple pixel including a blue super sub-pixel and a Tao's Triple pixel including a green super sub-pixel; and the display screen in FIG. 12(*c*) has two types of Tao's Triple pixel TTP-B and TTP-G, that is, a Tao's Triple pixel including a blue super sub-pixel and a Tao's Triple pixel including a green super sub-pixel. FIG. 13(*a*) and FIG. 13(*b*) show a portion of an exemplary coloured display screen in which each Tao's Triple pixel includes two super sub-pixels according to an embodiment of the present disclosure, wherein FIG. 13(*a*) shows the arrangement of identical colour between rows, and FIG. 13(*b*) shows the arrangement of different colours between rows. FIG. 14(*a*) and FIG. 14(*b*) show a portion of an exemplary coloured display screen in which each Tao's Triple pixel includes three super sub-pixels according to an embodiment of the present disclosure, wherein FIG. 14(*a*) shows the arrangement of identical colour between rows, and FIG. 14(*b*) shows the arrangement of different colours between rows.

The coloured display according to the above-described embodiment of the present disclosure is characterized in that two adjacent sub-pixels between any two adjacent pixels in a same row have an identical colour, wherein, several adjacent sub-pixels having the identical colour are combined into a super sub-pixel, and a black gap is eliminated in the super sub-pixel. The adjacent sub-pixels having the identical colour or the super sub-pixel increase saturation of a displayed colour, so that the coloured display screen proposed according to the embodiment of the present disclosure has colour saturation higher than that of an existing coloured display screen, the displayed colour is brighter, and levels are richer; and the super sub-pixel improves the utilization rate of a light source and reduces power consumption of the coloured display.

A luminous intensity of the super sub-pixel may be greater than either of luminous intensities of the two original adjacent sub-pixels (the two sub-pixels are combined to obtain the super sub-pixel), for example, be a sum of the luminous intensities of the original two adjacent sub-pixels (the two sub-pixels are combined to obtain the super sub-pixel). There are various methods for generating the super sub-pixel, for example:

In an active light-emitting coloured display screen such as AMOLED and LED, the super sub-pixel may be implemented by increasing a luminous intensity of a light-emitting unit corresponding to the super sub-pixel. For example, an area of the super sub-pixel may be the same as that of an ordinary sub-pixel, but its luminous intensity may be a sum of those of two original adjacent ordinary sub-pixels having an identical colour. Accordingly, since an average width of the sub-pixel is reduced, a height of the Tao's Triple pixel also needs to be adjusted, so that the aspect ratio of the Tao's Triple pixel is 3:1, that is, each pixel is a square on average.

In a passive light-emitting coloured display screen such as PMOLED and LCD, the super sub-pixel may be implemented by increasing an area of the light-emitting unit corresponding to the super sub-pixel. In this case, an area of the super sub-pixel is greater than an area of the ordinary sub-pixel, and its luminous intensity is also greater than the luminous intensity of either of the two original adjacent sub-pixels having the identical colour, for example, it is a sum of those of the two original adjacent ordinary sub-pixels having the identical colour. Generally, since the black gap between two adjacent sub-pixels having the identical colour is eliminated, a luminous efficiency the super sub-pixel is improved, and its area is generally less than the sum of those of the two sub-pixels. Therefore, since an average width of the sub-pixel is reduced to a certain extent, a height of the Tao's Triple pixel also needs to be adjusted, so that the aspect ratio of the Tao's Triple pixel is 3:1, that is, each pixel is a square on average.

More generally, in a case where the pixel group is composed of N pixels, an aspect ratio of the pixel group is set to N:1, so that each pixel is a square on average, where N is an integer greater than or equal to 3.

It should be noted that, in the foregoing exemplary display screen, a display screen whose adjacent sub-pixels having an identical colour are not combined and a display screen whose adjacent sub-pixels having an identical colour are selectively combined are shown, but these are merely examples; for example, a display screen may not only include the pixel group whose adjacent sub-pixels having an identical colour are not combined (i.e., a pixel group that does not include a super sub-pixel), but also include a pixel group whose adjacent sub-pixels having an identical colour are combined (i.e., a pixel group that includes a super sub-pixel), in addition, the number and a mode of combination of the adjacent sub-pixels having an identical colour may also be selected according to needs.

As an example, the display panel may be a liquid crystal display panel, an emission electroluminescent display panel, a plasma display panel, a field emission display panel, an electrophoretic display panel, a flash display panel, an incandescent display panel, a light emitting diode display panel, and an organic light emitting diode display panel, and the like.

In addition, the number and the types of the primary colours can be designed according to needs, for example, in addition to three primary colours of red, green and blue, four primary colours of red, green, blue and white may also be selected, and other primary colours may also be included, for example, cyan, magenta, and the like.

Figure 15:
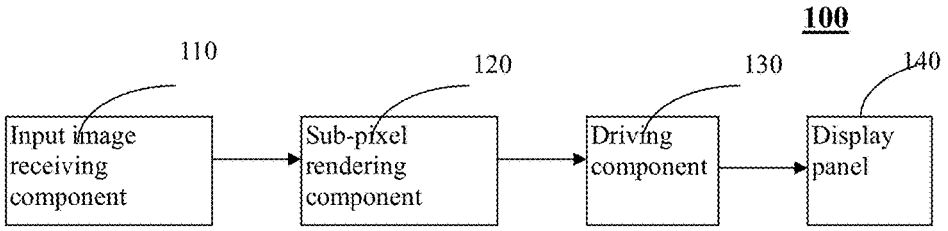
FIG. 15 shows a configuration block diagram of a display apparatus 100 according to an embodiment of the present disclosure.

FIG. 15 shows a configuration block diagram of a display apparatus 100 according to an embodiment of the present disclosure, the configuration block diagram only shows components closely related to the embodiment of the present disclosure, but the configuration is neither limitative nor exhaustive, and other components may also be included.

As shown in FIG. 15, the display apparatus 100 may include an input image receiving component 110, a sub-pixel rendering component 120, a driving component 130 and a display panel 140.

The input image receiving component 110 is used for receiving input image data of a first format which would be rendered by the display apparatus in an output display format. A format of the input image data may be a conventional three-colour "full-pixel" RGB format, and may also be other formats such as sRGB, YCbCr, RGBW, etc., and the output display format is determined by layout of sub-pixels in the display screen. In a case where a colour space of the input image data is different from an output colour space, the input image receiving component 110 may include a function of performing colour gamut mapping on the input image data; for example, if input data is in an RGB format, and rendering is to be performed on the RGBW display panel, it is necessary to perform a colour gamut mapping operation, so as to utilize the W primary colour on the panel. Of course, instead of incorporating the colour gamut mapping function into the input data receiving component 110, such a colour gamut mapping function may also be implemented by other components independent of the mapped data receiving component 110 or by a dedicated colour gamut mapping component.

The sub-pixel rendering component 120 is used for executing a sub-pixel rendering operation based on the input image data (including the input image data subjected to, for example, a colour gamut mapping process), to generate a brightness value of each sub-pixel on the display panel. Based on such a brightness value, the driving component 130 transmits a signal to each sub-pixel of the display panel, so as to implement that the input image data of the first format is displayed on the display panel in a way that pleases a viewer. That is, the sub-pixel rendering operation provides a brightness value for each sub-pixel on the display panel.

The display panel 140 may be the display panel provided by the above-described embodiment of the present disclosure, which is mainly constituted by repeating pixel groups, the pixel group being composed of a pre-determined number of pixels arranged in a row, and each pixel being constituted by arraying sub-pixels of at least two different primary colours in different orders, wherein adjacent sub-pixels between adjacent pixels in the pixel group have an identical colour, and the first sub-pixel and the last sub-pixel in the pixel group have an identical colour.

An example of the determination method of the sub-pixel brightness according to the embodiment of the present disclosure is described below.

As a comparison, a determination method of the sub-pixel brightness of a conventional display is described at first.

Figure 16:
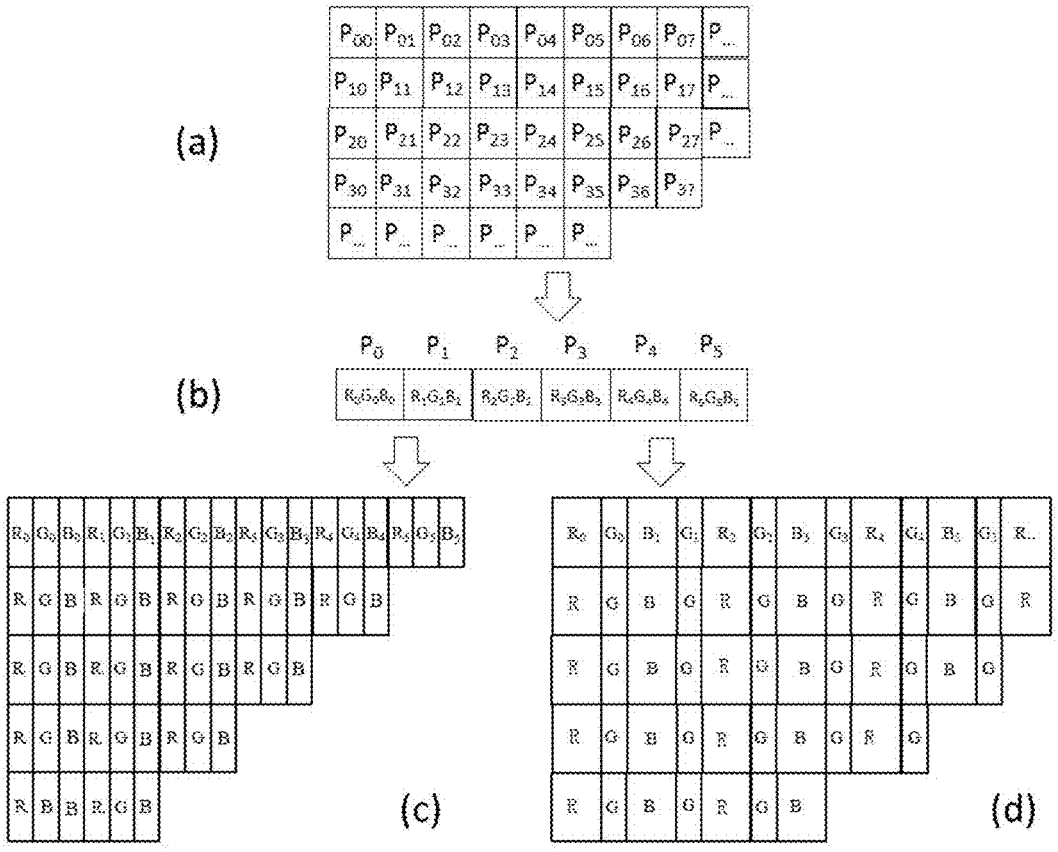
FIGS. 16(*a*)-(*d*) show principle diagrams from image data to panel display of a conventional display.

FIGS. 16(*a*)-(*d*) show principle diagrams from image data to panel display of a conventional display, wherein FIG. 16(*a*) shows a partial input image data of a coloured image having a plurality of pixels, where Pij represents partial input image data of a pixel in Row i and Column j, i and j are integers greater than or equal to 0; FIG. 16(*b*) shows colour values of 6 pixels P0 to P5 in the image shown in FIG. 16(*a*), which are respectively (R0 G0, B0), . . . , (R5 G5, B5); FIG. 16(*c*) shows that the conventional RGB display directly displays the image according to the numerical value of FIG. 16(*b*), that is, a colour value of the sub-pixel of one pixel on the display directly corresponds to a colour value of the sub-pixel of a corresponding pixel on the image; FIG. 16(*d*) shows that the conventional RGBG display displays an image only according to partial numerical values in FIG. 16(*b*), for example, for the pixel data of a first column of the image, it corresponds to sub-pixels of Columns R0 and G0 of the first column and the second column from the left of the display panel in FIG. 16(*d*), so as to discard a B0 colour value in the corresponding input pixel data; for the pixel data of the second column of the input image, it corresponds to sub-pixels of columns B1 and G1 of the third column and the fourth column from the left of the display panel in FIG. 16(*d*), so as to discard an R1 colour value in the corresponding input pixel data; and so on.

Figure 17:
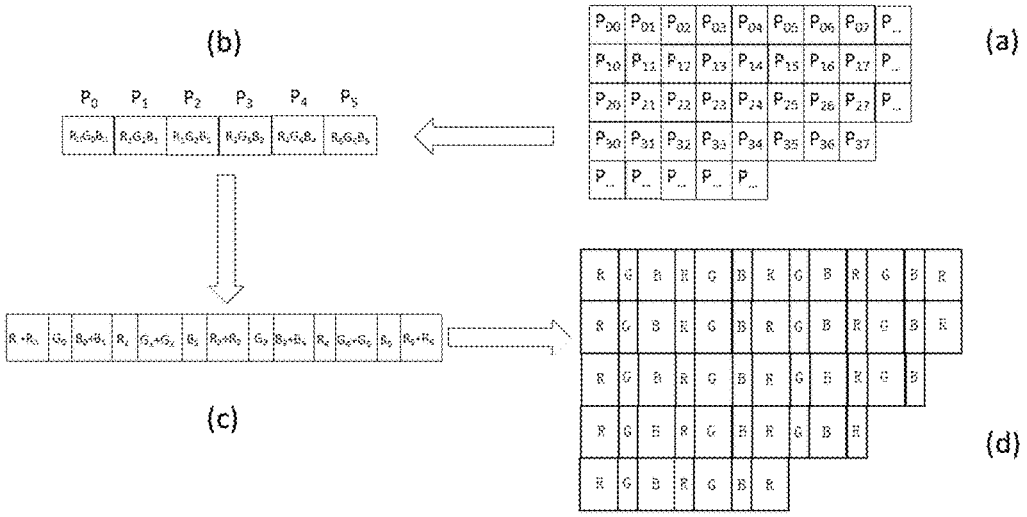
FIGS. 17(*a*)-(*d*) show principle diagrams from image data to panel display of a Tao's Triple pixel display (TTPD) according to an embodiment of the present disclosure.

FIGS. 17(*a*)-(*d*) show principle diagrams from image data to panel display of a Tao's Triple pixel display (TTPD) according to an embodiment of the present disclosure, wherein FIG. 17(*a*) shows partial input image data of a coloured image having a plurality of pixels, where Pij represents partial input image data of a pixel in Row i and Column j, and i and j are integers greater than or equal to 0; FIG. 17(*b*) shows colour values of six pixels P0 to P5 in the image shown in FIG. 17(*a*), which are respectively (R0, G0, B0), . . . , (R5, G5, B5); FIG. 17(*c*) shows that according to an arrangement mode of sub-pixels in FIG. 14(*a*), a colour value (e.g., brightness) of the super sub-pixel is calculated according to a sum of colour values (e.g., brightness) of two adjacent sub-pixels having an identical colour, specifically, a red brightness value R0 of a first pixel P0 and a red brightness value (referred to as R.) of a pixel (referred to as P.) before P0 in the input image data are added to obtain a brightness value of a red super sub-pixel of the first column on the display panel, then a green brightness value G0 of the first pixel P0 in the input image data is directly taken as a brightness value of a green sub-pixel of the second column of the display panel. Next, a blue brightness value B0 of the first pixel P0 and a blue brightness value B1 of the second pixel P1 in the input image data are added to obtain a brightness value of a blue super sub-pixel of the third column on the display panel. Next, a red brightness value R1 of the second pixel P1 is taken as a brightness value of the red sub-pixel of the fourth column of the display panel, a green brightness value G1 of the second pixel P1 and a green brightness value G2 of a third pixel P2 are added to obtain a brightness value of a green sub-pixel of the fifth column on the display panel, and a blue brightness value B2 of the third pixel P2 is taken as a brightness value of a blue sub-pixel of the fifth column on the display panel, a red brightness value R2 of the third pixel P2 and the red brightness value R3 of the fourth pixel P3 are added to obtain a brightness value of a red sub-pixel of the sixth column, and so on; and FIG. 17(*d*) shows that the calculated value in FIG. 17(*c*) are transmitted to the Tao's Triple Pixel display (TTPD) for display.

Figure 18:
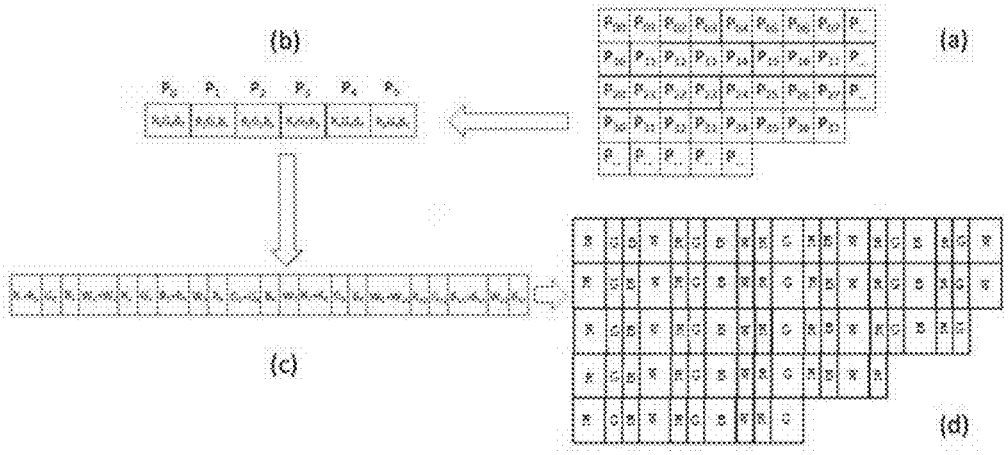
FIGS. 18(*a*)-(*d*) show principle diagrams from image data to panel display of a Tao's Octagonal pixel display (TTPD) according to an embodiment of the present disclosure.

FIGS. 18(*a*)-(*d*) show principle diagrams from image data to panel display of a Tao's Octagonal pixel display (TTPD) according to an embodiment of the present disclosure, wherein FIG. 18(*a*) shows partial input image data of a coloured image having a plurality of pixels, where Pij represents partial input image data of a pixel in Row i and Column j, and i and j are integers greater than or equal to 0; FIG. 18(*b*) specifically shows colour values of six pixels P0 to P5 in the image shown in FIG. 18(*a*), which are respectively (R0, G0, B0), . . . , (R5, G5, B5); and their colour values are (R0, G0, B0), . . . , (R5, G5, B5); FIG. 18(*c*) shows that according to an arrangement mode of sub-pixels in FIG. 11(*b*), a colour value (e.g., brightness) of the super sub-pixel is calculated according to a sum of colour values (e.g., brightness) of two adjacent sub-pixels having an identical colour, specifically, a red brightness value R0 of the first pixel P0 and a red brightness value (referred to as R.) of the pixel (referred to as P.) before P0 in the input image data are added to obtain a brightness value of a red super sub-pixel of the first column on the display panel, then a green brightness value G0 of the first pixel P0 in the input image data is directly taken as a brightness value of a green sub-pixel of the second column on the display panel. Next, a blue brightness value B1 of the second pixel P1 in the input image data is taken as a brightness value of a blue sub-pixel of the third column on the display panel, a white brightness value W1 of the second pixel P1 and a white brightness value W2 of the third pixel P2 in the input image data are added to obtain a brightness value of a white super sub-pixel of the fourth column on the display panel. Next, a red brightness value R2 of the third pixel P2 is taken as a brightness value of a red sub-pixel of the fifth column on the display panel, a green brightness value G3 of a fourth pixel P3 is taken as a brightness value of a green sub-pixel of the sixth column on the display panel, a blue brightness value B3 of the fourth pixel P3 and a blue brightness value B4 of a fifth pixel P4 are added as a blue sub-pixel of a seventh column on the display panel, and so on; and FIG. 18(*d*) shows that the calculated value in FIG. 18(*c*) are transmitted to the Tao's Octagonal Pixel display (TOPD) for display.

The method for rendering the sub-pixel according to the input image data and the arrangement mode of the sub-pixel in the display screen is illustrated above with the Tao's Triple Pixel display and the Tao's Octagonal Pixel display as an example. Combination of the display screen and the rendering method according to this embodiment enables the display apparatus to have advantages of high pixel density, low power consumption, and super colour reproduction ability.

According to still another embodiment of the present disclosure, there is provided a display apparatus, which may comprise: a display panel, constituted by arranging a plurality of pixels, each pixel being constituted by arranging sub-pixels of at least two different colours in a row, wherein adjacent sub-pixels between adjacent pixels in a same row or adjacent sub-pixels between adjacent pixel pairs in a same row have an identical colour; and a driving circuit, for transmitting a signal to each sub-pixel of the display panel.

In one example, in the display apparatus according to the above-described embodiment, adjacent sub-pixels having the identical colour, of the adjacent pixels in a same row are selectively combined into a super sub-pixel, there is no black gap in the super sub-pixel, and its brightness is greater than that of any one of the combined original sub-pixels having the identical colour.

According to an embodiment of the present disclosure, there is provided a sub-pixel rendering method of a display apparatus, the display apparatus comprising: a display panel, mainly constituted by arranging a plurality of pixels, each pixel being constituted by arranging sub-pixels having different colours in a row, wherein adjacent sub-pixels between adjacent pixels in a same row or adjacent sub-pixels between adjacent pixel pairs in a same row have an identical colour, wherein, adjacent sub-pixels, having the identical colour, of the adjacent pixels in a same row are combined into a super sub-pixel, there is no black gap in the super sub-pixel, and the brightness of the super sub-pixel is greater than that of any one of the combined original sub-pixels having the identical colour, and an arrangement mode of the sub-pixels in the display panel defines an output display format. The sub-pixel rendering method comprises: receiving input image data of a first format, so that the display apparatus renders in the output display format; executing sub-pixel rendering operation based on the input image data, to generate a brightness value of each sub-pixel on the display panel; transmitting a signal to each sub-pixel of the display panel, wherein the rendering a super sub-pixel includes: obtaining a colour value corresponding to a colour of the super sub-pixel in the colour value of each of the associated two pixels of the input image data; and taking a summation result of the two corresponding colour values as the colour value of the super sub-pixel.

The descriptions of the various embodiments of the present disclosure have been presented for purposes of illustration, but are not intended to be exhaustive or limited to the embodiments disclosed. Many combinations, sub-combinations, modifications and variations will be apparent to those of ordinary skill in the art without departing from the scope and spirit of the described embodiments. Thus, the scope of the disclosure shall be determined by the scope of the claims.

The invention claimed is:

1. A display panel, mainly constituted by repeating pixel groups, the pixel group being composed of a pre-determined number of pixels arranged in a row, and each pixel being constituted by arraying sub-pixels of at least two different primary colours in different orders, wherein adjacent sub-pixels between adjacent pixels in each pixel group or adjacent sub-pixels between adjacent pixel pairs in each pixel group have an identical colour, and the first sub-pixel and the last sub-pixel in the pixel group have an identical colour, wherein, one or more pairs among pairs constituted by the adjacent sub-pixels, having the identical colour, of the adjacent pixels in each pixel group and pairs constituted by the adjacent sub-pixels, having the identical colour, of the adjacent pixels between the pixel groups are combined into a super sub-pixel, there is no black gap in the super sub-pixel obtained as so combined, and the brightness of the super sub-pixel is greater than that of any one of a combined original sub-pixels having the identical colour, wherein in a case where the display panel is an active light-emitting display panel, an area of the super sub-pixel is the same as that of the other sub-pixel; and wherein in a case where the display panel is a passive light-emitting display panel, an area of the super sub-pixel obtained as so combined is greater than that of the other sub-pixel.

2. The display panel according to claim 1, wherein, the sub-pixels in each pixel group include sub-pixels of all the primary colours, and proportions of the sub-pixels of respective primary colours in the pixel group are the same.

3. The display panel according to claim 1, wherein, a luminous intensity of the super sub-pixel obtained as so combined is a sum of luminous intensities of a combined sub-pixel pairs having an identical colour.

4. The display panel according to claim 1, wherein, the super sub-pixels in the pixel group are of one or more colours.

5. The display panel according to claim 1, wherein, in a case where the display panel is a passive light-emitting display panel, the area of the super sub-pixel obtained as so combined is substantially a sum of areas of the combined sub-pixel pairs having the identical colour.

6. The display panel according to claim 1, wherein, the pixel group is composed of N pixels, and an aspect ratio of the pixel group is N:1, so that each pixel is a square on average, where N is an integer greater than or equal to 3.

7. The display panel according to any one of claim 1, a mode for repeating the pixel group includes an arrangement of identical colour between rows and an arrangement of different colours between rows, the arrangement of identical colour between rows refers to that the sub-pixels in corresponding positions between respective rows have an identical colour, and the arrangement of different colours between rows refers to that the sub-pixels in corresponding positions between respective rows have different colours.

8. The display panel according to claim 1, wherein, the pixel group is composed of three pixels, and each pixel is constituted by arranging sub-pixels of three different primary colours, the sub-pixels of the three pixels in the pixel group are arranged in a row in a mode below:

P1 P2 P3 P3 P1 P2 P2 P3 P1 where P1, P2 and P3 respectively represent a sub-pixel of a first primary colour, a sub-pixel of second primary colour and a sub-pixel of a third primary colour.

9. The display panel according to claim 8, wherein, the first primary colour, the second primary colour and the third primary colour are respectively one of red, green and blue.

10. The display panel according to claim 1, wherein, each pixel is constituted by arranging sub-pixels of three different primary colours, and the pixel group is constituted in either of two modes below:

a first mode:

the pixel group is composed of five pixels, and the sub-pixels of the five pixels in the pixel group are arranged in a row in a mode below:

P1 P2 P3 P3 P1 P2 P2 P3 P1 P1 P3 P2 P2 P3 P1 a second mode:

the pixel group is composed of six pixels, and the sub-pixels of the six pixels in the pixel group are arranged in a row in a mode below:

P1 P2 P3 P3 P1 P2 P2 P3 P1 P1 P3 P2 P2 P1 P3 P 3 P2 P1 where P1, P2 and P3 respectively represent a sub-pixel of a first primary colour, a sub-pixel of a second primary colour and a sub-pixel of a third primary colour.

11. The display panel according to claim 1, wherein, sub-pixels in the pixel group include four different primary colours, each pixel includes two sub-pixels, and a pixel pair is constituted by every four adjacent sub-pixels having different primary colours sequentially in an arrangement order, wherein, the adjacent sub-pixels between adjacent pixel pairs have an identical colour.

12. The display panel according to claim 11, wherein, the pixel group is composed of eight pixels, and each pixel includes two sub-pixels, the sub-pixels of the eight pixels in the pixel group are arranged in a row in a mode below:

P1 P2 P3 P4 P4 P1 P2 P3 P3 P4 P1 P2 P2 P3 P4 P1 a first pixel includes the sub-pixels P1 P2, a second pixel includes the sub-pixels P3 P4, a third pixel includes the sub-pixels P4 P1, a fourth pixel includes the sub-pixels P2 P3, . . . , and an eighth pixel includes the sub-pixels P4 P1, the first and the second pixels, the third and the fourth pixels, the fifth and the sixth pixels, the seventh and the eighth pixels sequentially constitute pixel pairs in a pairwise manner, and each pixel pair includes four primary-colour sub-pixels P1, P2, P3 and P4, where P1, P2, P3 and P4 respectively represent sub-pixels of the first primary colour, the second primary colour, the third primary colour and a fourth primary colour.

13. The display panel according to claim 11, wherein, the first primary colour, the second primary colour, the third primary colour and the fourth primary colour are respectively one of red, green, blue and white.

14. The display panel according to claim 1, wherein, the display panel is one of a liquid crystal display panel, an emission electroluminescent display panel, a plasma display panel, a field emission display panel, an electrophoretic display panel, a flash display panel, an incandescent display panel, a light emitting diode display panel and an organic light emitting diode display panel.

15. A display apparatus, comprising:

a display panel, mainly constituted by repeating pixel groups, the pixel group being composed of a predetermined number of pixels arranged in a row, and each pixel being constituted by arraying sub-pixels of at least two different primary colours in different orders, wherein adjacent sub-pixels between adjacent pixels in each pixel group or adjacent sub-pixels between adjacent pixel pairs in each pixel group have an identical colour, and the first sub-pixel and the last sub-pixel in the pixel group have an identical colour; and a driving circuit, for transmitting a signal to each sub-pixel of the display panel, wherein, one or more pairs among pairs constituted by the adjacent sub-pixels, having the identical colour, of the adjacent pixels in each pixel group and pairs constituted by the adjacent sub-pixels, having the identical colour, of the adjacent pixels between the pixel groups are combined into a super sub-pixel, there is no black gap in the super sub-pixel obtained as so combined, and the brightness of the super sub-pixel is greater than that of any one of a combined original sub-pixels having the identical colour, wherein, an arrangement mode of the sub-pixels in the pixel group defines an output display format; and the display apparatus further comprises:

an input image receiving component, for receiving input image data in a first format, for being rendered by the display apparatus in the output display format; and a sub-pixel rendering component, for executing a sub-pixel rendering operation based on the input image data, to generate a brightness value of each sub-pixel on the display panel.

16. The display apparatus according to claim 15, wherein, the input image data is in a format of an RGB colour values of each pixel, the pixel group of the display panel is composed of three pixels, each pixel is constituted by arranging sub-pixels of three different primary colours, and the sub-pixels of the three pixels in the pixel group are arranged in a row in a mode below:

P1 P2 P3 P3 P1 P2 P2 P3 P1 where, P1, P2 and P3 respectively represents one of red R, green G and blue B and are different from one another, and at least one pair of a P1 sub-pixel of a first pixel in the pixel group and an adjacent P1 sub-pixel of the third pixel in a immediately before pixel group, two adjacent P3 sub-pixels of the first pixel and the second pixel in the pixel group, two adjacent P2 sub-pixels of the second pixel and the third pixel in the pixel group, and a P1 sub-pixel of the third pixel in the pixel group and an adjacent P1 sub-pixel of a first pixel in a next pixel group, is combined into a super sub-pixel, for a super sub-pixel, the sub-pixel rendering component calculates to obtain the brightness value of the super sub-pixel, based on brightness values of corresponding colours in RGB colour values of the two pixels associated with the super sub-pixel.

17. The display apparatus according to claim 16, wherein, a sum of the brightness values of the corresponding colours in RGB colour values of the two pixels associated with the super sub-pixel is calculated as the brightness value of the super sub-pixel.

18. A sub-pixel rendering method of a display apparatus, the display apparatus comprising: a display panel, constituted by arranging a plurality of pixels, each pixel being constituted by arranging sub-pixels having different colours in a row, wherein adjacent sub-pixels between adjacent pixels in a same row or adjacent sub-pixels between adjacent pixel pairs in a same row have an identical colour, wherein, adjacent sub-pixels, having the identical colour, of the adjacent pixels in a same row are selectively combined into a super sub-pixel, there is no black gap in the super sub-pixel, and brightness of the super sub-pixel is greater than that of any one of a combined original sub-pixels having the identical colour, and an arrangement mode of the sub-pixels in the display panel defines an output display format;

the sub-pixel rendering method comprising:

receiving input image data in a first format, for being rendered by the display apparatus in the output display format;

executing a sub-pixel rendering operation based on the input image data, to generate a brightness value of each sub-pixel on the display panel;

transmitting a signal to each sub-pixel of the display panel, wherein rendering a super sub-pixel includes: obtaining a colour value corresponding to a colour of the super sub-pixel in the colour value of each of the associated two pixels in the input image data; and taking a summation result of the two corresponding colour values as the colour value of the super sub-pixel.

* * * * *